US008072398B2

(12) United States Patent
Lee et al.

(10) Patent No.: US 8,072,398 B2
(45) Date of Patent: Dec. 6, 2011

(54) ELECTROLUMINESCENCE DISPLAY DEVICE HAVING A LOOK-UP TABLE AND DRIVING METHOD THEREOF

(75) Inventors: Han Sang Lee, Uiwang-shi (KR); Nam Wook Cho, Kunpo-shi (KR)

(73) Assignee: LG Display Co., Ltd., Seoul (KR)

( * ) Notice: Subject to any disclaimer, the term of this patent is extended or adjusted under 35 U.S.C. 154(b) by 1107 days.

(21) Appl. No.: 10/825,363

(22) Filed: Apr. 16, 2004

(65) Prior Publication Data

US 2005/0140597 A1 Jun. 30, 2005

(30) Foreign Application Priority Data

Dec. 30, 2003 (KR) ..... 10-2003-100653

(51) Int. Cl.
*G09G 3/30* (2006.01)

(52) U.S. Cl. ..... 345/77; 345/83

(58) Field of Classification Search ..... 345/76, 345/83, 87, 41, 37, 690, 77
See application file for complete search history.

(56) References Cited

U.S. PATENT DOCUMENTS

| | | | | |
|---|---|---|---|---|
| 6,462,735 | B2 * | 10/2002 | Naito | 345/204 |
| 6,919,691 | B2 * | 7/2005 | Mizukoshi et al. | 345/77 |
| 6,972,772 | B1 * | 12/2005 | Chen et al. | 345/88 |
| 7,030,842 | B2 * | 4/2006 | Ha et al. | 345/76 |
| 7,158,156 | B2 * | 1/2007 | Endou | 345/77 |
| 2001/0026283 | A1 * | 10/2001 | Yoshida et al. | 345/600 |
| 2001/0028335 | A1 * | 10/2001 | Hasegawa et al. | 345/76 |
| 2002/0063666 | A1 * | 5/2002 | Kang et al. | 345/87 |
| 2002/0158882 | A1 * | 10/2002 | Liaw et al. | 345/589 |
| 2006/0004201 | A1 * | 1/2006 | Nakaya et al. | 546/49 |

FOREIGN PATENT DOCUMENTS

| | | | |
|---|---|---|---|
| CN | 1 432 988 | A | 7/2003 |
| EP | 1638071 | A2 * | 3/2006 |
| JP | 2-271389 | | 11/1990 |
| JP | 8-227283 | | 9/1996 |
| JP | 2002-082645 | | 3/2002 |
| JP | 2002-341828 | | 11/2002 |
| JP | 2003-029724 | | 1/2003 |
| JP | 2003-255900 | | 9/2003 |
| JP | 2003-308042 | | 10/2003 |

* cited by examiner

*Primary Examiner* — Chanh Nguyen
*Assistant Examiner* — Allison Walthall
(74) *Attorney, Agent, or Firm* — McKenna Long & Aldridge, LLP

(57) ABSTRACT

A flat panel display device and a driving method thereof wherein an input data is modulated to realize accurate color with a single gamma voltage. The flat panel display device includes a data converter having a look-up table and inputted with Red, Green and Blue N-bit digital data signals, the data converter converting the Red, Green and Blue N-bit digital data signals into Red, Green and Blue M-bit digital data signals, respectively, referring to the look-up table, wherein each of N and M is an integer, M is greater than N, and each of the Red, Green and Blue M-bit digital data signals corresponds to a gray scale number; a gamma voltage generator generating a plurality of gamma voltages corresponding to the gray scale numbers; and a data driving circuit inputted with the gamma voltages, the data driving circuit converting the Red, Green and Blue M-bit digital data signals into Red, Green and Blue analog video signals, respectively, and applying the Red, Green and Blue analog video signals to respective Red, Green and Blue pixels.

4 Claims, 8 Drawing Sheets

ELECTROLUMINESCENCE DISPLAY DEVICE HAVING A LOOK-UP TABLE AND DRIVING METHOD THEREOF

This application claims the benefit of Korean Patent Application No. 2003-100653, filed on Dec. 30, 2003, which is hereby incorporated by reference for all purposes as if fully set forth herein.

BACKGROUND OF THE INVENTION

1. Field of the Invention

This invention relates to a flat panel display device, and more particularly to a flat panel display device and a driving method thereof, wherein input video data are modulated to realize accurate color with a single gamma voltage generator.

2. Discussion of the Related Art

Recently, various flat panel display devices have been developed with reduced weight and size that are capable of eliminating the disadvantages associated with a cathode ray tube (CRT). Such flat panel display devices include liquid crystal displays (LCD), field emission displays (FED), plasma display panels (PDP) and electro-luminescence (EL) panels.

The EL display in such display devices is a self-emission device in which a phosphorous material is excited using recombination of electrons and holes. The EL display device is generally classified into inorganic EL devices and organic EL devices, depending upon a source material for the light-emitting layer. The EL display device has drawn considerable attention due to its advantages such as low voltage driving, self-luminescence, thin-thickness, wide viewing angle, fast response speed, and high contrast ratio.

FIG. 1 is a cross-sectional view showing a related art organic EL structure for explaining a light-emitting principle of the EL display device.

Referring to FIG. 1, the organic EL device includes an electron injection layer 4, an electron carrier layer 6, a light-emitting layer 8, a hole carrier layer 10 and a hole injection layer 12 that are sequentially disposed between a cathode 2 and an anode 14.

If a voltage is applied between a transparent electrode, that is, the anode 14 and a metal electrode, that is, the cathode 2, then electrons produced from the cathode 2 are moved, via the electron injection layer 4 and the electron carrier layer 6, into the light-emitting layer 8, while holes produced from the anode 14 are moved, via the hole injection layer 12 and the hole carrier layer 10, into the light-emitting layer 10. Thus, the electrons and the holes fed from the electron carrier layer 6 and the hole carrier layer 10, respectively, collide at the light-emitting layer 8 to be recombined to generate a light. This light is emitted, via the transparent electrode (i.e., the anode 14), into the exterior to thereby display a picture. Since brightness of the organic EL device is in proportion to supply currents instead of the voltage loaded on each end of the device, the anode 14 is generally connected to a positive current source.

As shown in FIG. 2, an active matrix type EL display device employing such an organic EL device includes an EL panel 16 having pixels 28 arranged at the intersections between gate lines GL and data lines DL, a gate driver 18 for driving the gate lines GL of the EL panel 16, a data driver 20 for driving the data lines DL of the EL panel 16. The active matrix type EL display device further includes a timing controller 40 for controlling driving timing of the data driver 20 and the gate driver 18 and for applying a digital data signal RGB to the data driver 20. The timing controller 40 applies the digital data signal RGB from the exterior (i.e., system) to the data driver 20, and generates a gate control signal GCS, which is required for driving the gate driver 18, and a data control signal DCS, which is required for driving the data driver 20, using vertical/horizontal synchronizing signals and a main clock from the exterior.

The gate driver 18 sequentially applies a scanning pulse to gate lines GL1 to GLn under control of the timing controller 40. The data driver 20 converts a digital data signal inputted from the timing controller 40 into an analog video signal in response to the data control signal (DCS) from the timing controller 40. Further, the data driver 20 applies the analog video signal synchronized with the scanning pulse to data lines DL1 to DLm for each one line.

Each of the pixels 28 receives a data signal from the data line DL when the scanning pulse is applied to the gate line GL, thereby generating a light corresponding to the data signal. To this end, as shown in FIG. 3, each pixel 28 includes an EL cell OEL having a cathode connected to the ground voltage source GND, and a cell driver 30 connected to the gate line GL, the data line DL and the supply voltage source VDD and to the anode of the EL cell OEL to thereby drive the EL cell OEL.

The cell driver 30 includes a switching thin film transistor T1 having a gate terminal connected to the gate line GL, a source terminal connected to the data line DL and a drain terminal connected to a first node N1, a driving thin film transistor T2 having a gate terminal connected to the first node N1, a source terminal connected to the supply voltage source VDD and a drain terminal connected to the EL cell OEL, and a capacitor C connected between the supply voltage source VDD and the first node N1.

The switching thin film transistor T1 is turned on when a scanning pulse is applied to the gate line GL, to thereby apply a data signal supplied to the data line DL to the first node N1. The data signal supplied to the first node N1 is charged into the capacitor C and applied to the gate terminal of the driving thin film transistor T2. The driving thin film transistor T2 controls a current amount I fed from the supply voltage source into the EL cell OEL in response to the data signal applied to the gate terminal thereof, to thereby control an amount of light emitted from the EL cell OEL. Furthermore, since the data signal is discharged from the capacitor C even though the switching thin film transistor T1 is turned off, the driving thin film transistor T2 applies a current I from the supply voltage source VDD until a data signal at the next frame is supplied, to thereby maintain the emission of the EL cell OEL.

The related art EL display device applies a current signal proportional to an input data to each of the EL cells OEL to radiate the EL cells OEL, thereby displaying a picture. Herein, the EL cells OEL includes a R cell OEL having a red (R) phosphorous material, a G cell OEL having a green (G) phosphorous material, and a B cell OEL having a blue (B) phosphorous material in order to implement color. The three R, G and B cells OEL are combined to implement a color for one pixel. Herein, each of the R, G and B phosphorous materials has different light-emission efficiency. In other words, if data signals having the same level are applied to the R, G and B cells OEL, then brightness levels of the R, G and B cells OEL become different from each other. Thus, gamma voltages for each R, G and B cell are set to be different from each other in order to compensate different brightness of R, G and B cells at a same voltage level for the sake of white balance of the R, G and B cells. Accordingly, as shown in FIG. 4, the R, G and B cells include an R gamma voltage generator 32, a G gamma voltage generator 34 and a B gamma voltage generator 36 for generating gamma voltages having different voltage levels, respectively.

As shown in FIG. 5, the R gamma voltage generator 32 generates n gamma voltages (wherein n is an integer) in such a manner to correspond to different brightness data. To this end, the R gamma voltage generator 32 includes (n+1) resistors R11, R12, R13, R14, . . . , R1n+1 connected, in series, between a first supply voltage source VDD1 and a ground voltage source GND. Such an R gamma voltage generator 32 outputs n red gamma voltages RGMA1 to RGMAn corresponding to the bit number of a red digital data signal Rdata inputted from the timing controller 40 to the data driver 20 from nodes between the resistors R11, R12, R13, R14, . . . , R1n+1 connected, in series, between the first supply voltage source VDD1 and the ground voltage source GND.

The G gamma voltage generator 34 generates n gamma voltages in such a manner to correspond to different brightness data as shown in FIG. 5. To this end, the G gamma voltage generator 34 includes (n+1) resistors R21, R22, R23, R24, . . . , R2n+1 connected, in series, between a second supply voltage source VDD2 and a ground voltage source GND. Such an G gamma voltage generator 34 outputs n green gamma voltages GGMA1 to GGMAn corresponding to the bit number of a green digital data signal Gdata inputted from the timing controller 40 to the data driver 20 from nodes between the resistors R21, R22, R23, R24, . . . , R2n+1 connected, in series, between the second supply voltage source VDD2 and the ground voltage source GND.

The B gamma voltage generator 36 generates n gamma voltages in such a manner to correspond to different brightness data as shown in FIG. 5. To this end, the B gamma voltage generator 36 includes (n+1) resistors R31, R32, R33, R34, . . . , R3n+1 connected, in series, between a third supply voltage source VDD3 and a ground voltage source GND. Such an B gamma voltage generator 36 outputs n blue gamma voltages BGMA1 to BGMAn corresponding to the bit number of a blue digital data signal Bdata inputted from the timing controller 40 to the data driver 20 from nodes between the resistors R31, R32, R33, R34, . . . , R3n+1 connected, in series, between the third supply voltage source VDD3 and the ground voltage source GND.

In such first to third supply voltage source VDD1, VDD2 and VDD3, the first supply voltage source VDD1 generates a higher voltage value than the second and third supply voltage sources VDD2 and VDD3 because the R,G and B phosphorous materials have different light-emission efficiencies. In this case, the third supply voltage source VDD3 generates a smaller voltage value than the second supply voltage source VDD2.

Accordingly, the data driver 20 generates analog video signals using the gamma voltages RGMA1 to RGMAn; GGMA1 to GGMAn and BGMA1 to BGMAn corresponding to input digital data signals, of a plurality of gamma voltages RGMA1 to RGMAn; GGMA1 to GGMAn and BGMA1 to BGMAn supplied from the R gamma voltage generator 32, the G gamma voltage generator 34 and the B gamma voltage generator 36, respectively, and applies the generated analog video signals to the data lines DL in such a manner to be synchronized with the scanning signal, thereby displaying a desired picture at the EL panel 20.

However, the related art EL display device has a problem in that, since the data driver 20 includes the R gamma voltage generator 32, the G gamma voltage generator 34 and the B gamma voltage generator 36 for white balance of the R, G and B phosphorous materials having different light-emission efficiencies, its size is enlarged and its cost is increased.

SUMMARY OF THE INVENTION

Accordingly, the present invention is directed to a flat panel display device and a driving method thereof that substantially obviates one or more of the problems due to limitations and disadvantages of the related art.

An advantage of the present invention is to provide a flat panel display device and a driving method thereof wherein input video data are modulated to thereby make an accurate color implementation even with a single gamma voltage.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a flat panel display device may, for example, include a data converter having a look-up table and inputted with Red, Green and Blue N-bit digital data signals, the data converter converting the Red, Green and Blue N-bit digital data signals into Red, Green and Blue M-bit digital data signals, respectively, referring to the look-up table, wherein each of N and M is an integer, M is greater than N, and each of the Red, Green and Blue M-bit digital data signals corresponds to a gray scale number; a gamma voltage generator generating a plurality of gamma voltages corresponding to the gray scale numbers; and a data driving circuit inputted with the gamma voltages, the data driving circuit converting the Red, Green and Blue M-bit digital data signals into Red, Green and Blue analog video signals, respectively, and applying the Red, Green and Blue analog video signals to respective Red, Green and Blue pixels.

In another aspect of the present invention, a method of driving a flat panel display device may, for example, include receiving Red, Green and Blue N-bit digital data signals; converting the Red, Green and Blue N-bit digital data signal into Red, Green and Blue M-bit digital data signals, respectively, wherein each of N and M is an integer, M is greater than N, and each of the Red, Green and Blue M-bit digital data signals corresponds to a gray scale number; converting the Red, Green and Blue M-bit digital data signals into Red, Green and Blue analog video signals, respectively; and applying the Red, Green and Blue analog video signals to respective Red, Green and Blue pixels.

In another aspect of the present invention, a method of driving a flat panel display device having a pixel may, for example, include receiving a N-bit digital data signal; converting the N-bit digital data signal into a M-bit digital data signal, wherein each of N and M is an integer and M is greater than N; converting the M-bit digital data signal into an analog video signal; and applying the analog video signal to the pixel.

In still another aspect of the present invention, a flat panel display device having a pixel may, for example, include a data converter inputted with a N-bit digital data signal for converting the N-bit digital data signal into a M-bit digital data signal, wherein each of N and M is an integer and M is greater than N; and a data driving circuit inputted with the M-bit digital data signal for generating an analog video signal and applying the analog video signal to the pixel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings.

Figure 6:
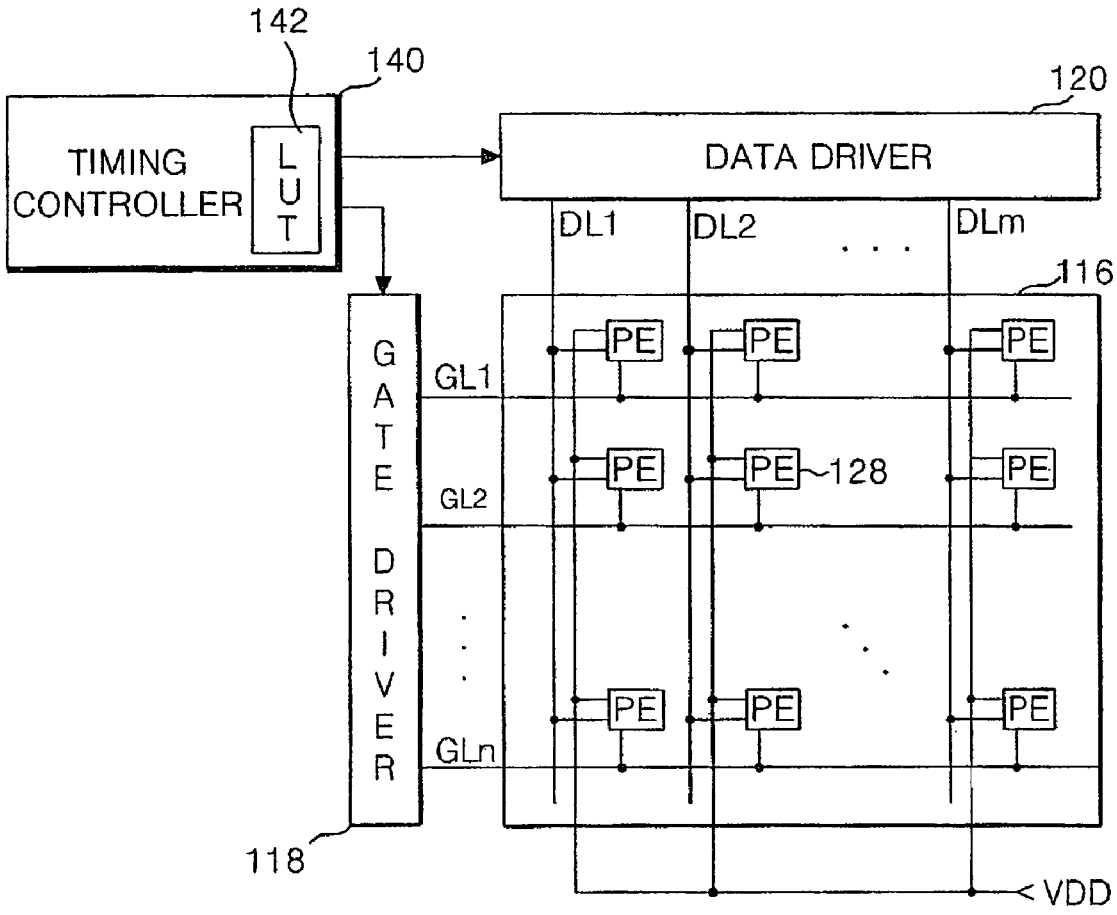
FIG. 6 is a schematic block diagram showing a configuration of a driving apparatus for an electro-luminescence display panel of a flat panel display device according to an embodiment of the present invention.

Referring to FIG. 6, an electro-luminescence (EL) display device according to an embodiment of the present invention includes an EL panel 116 having pixels 128 arranged at the intersections between gate lines GL and data lines DL, a gate driver 118 for driving the gate lines GL of the EL panel 116, a data driver 120 for driving the data lines DL of the EL panel 116. The electro-luminescence (EL) display device further includes a timing controller 140 for controlling driving timing of the data driver 120 and the gate driver 118 and for converting a N-bit digital data signal RGB (wherein N is an integer) from the exterior into a M-bit digital data signal MRGB (wherein M is an integer larger than N) to apply it to the data driver 120.

Each of the pixels 128 receives a data signal from the data line DL when a scanning pulse is applied to the gate line GL to thereby generate a light corresponding to the data signal.

Figure 1:
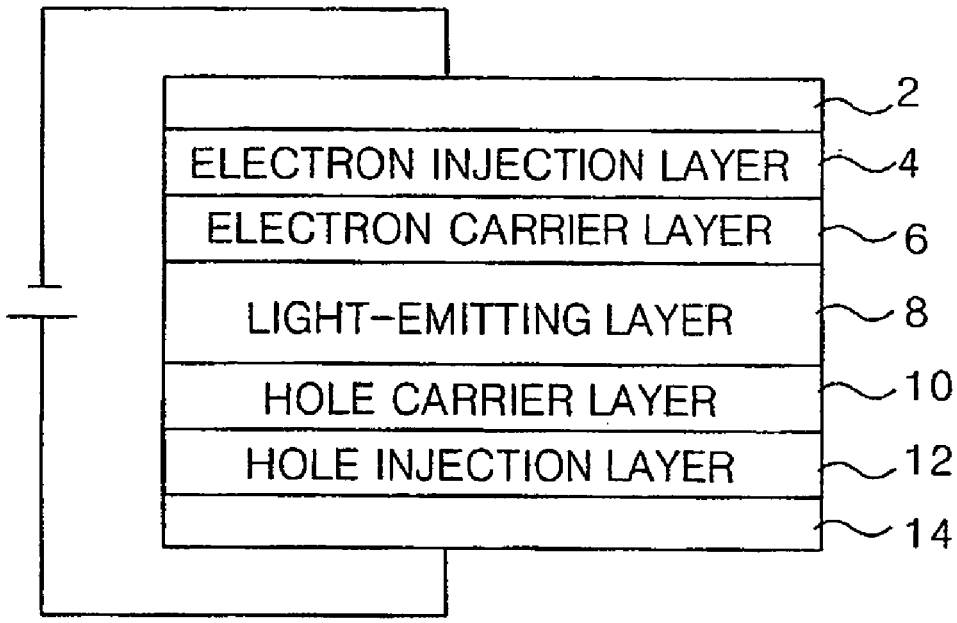
FIG. 1 RELATED ART
FIG. 1 is a schematic cross-sectional view showing a structure of a related art electro-luminescence display device.
Figure 2:
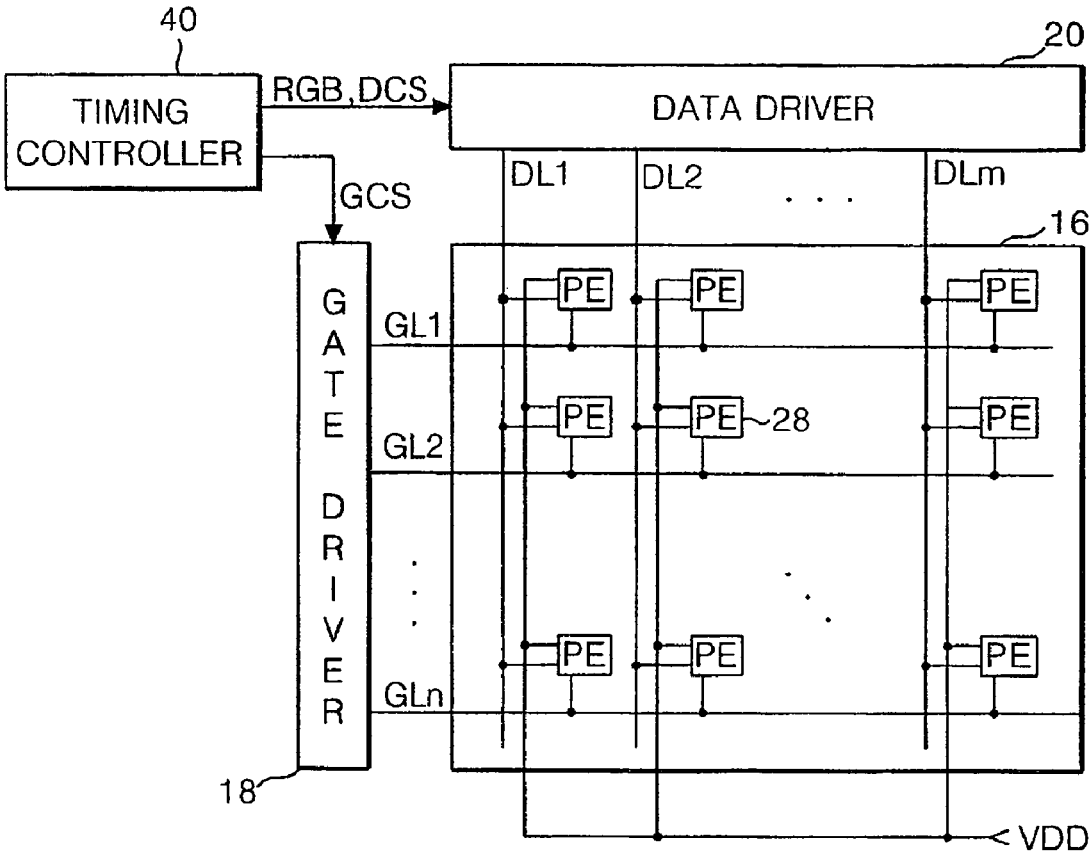
FIG. 2 RELATED ART
FIG. 2 is a schematic block diagram showing a configuration of a driving apparatus for the related art electro-luminescence display panel.
Figure 3:
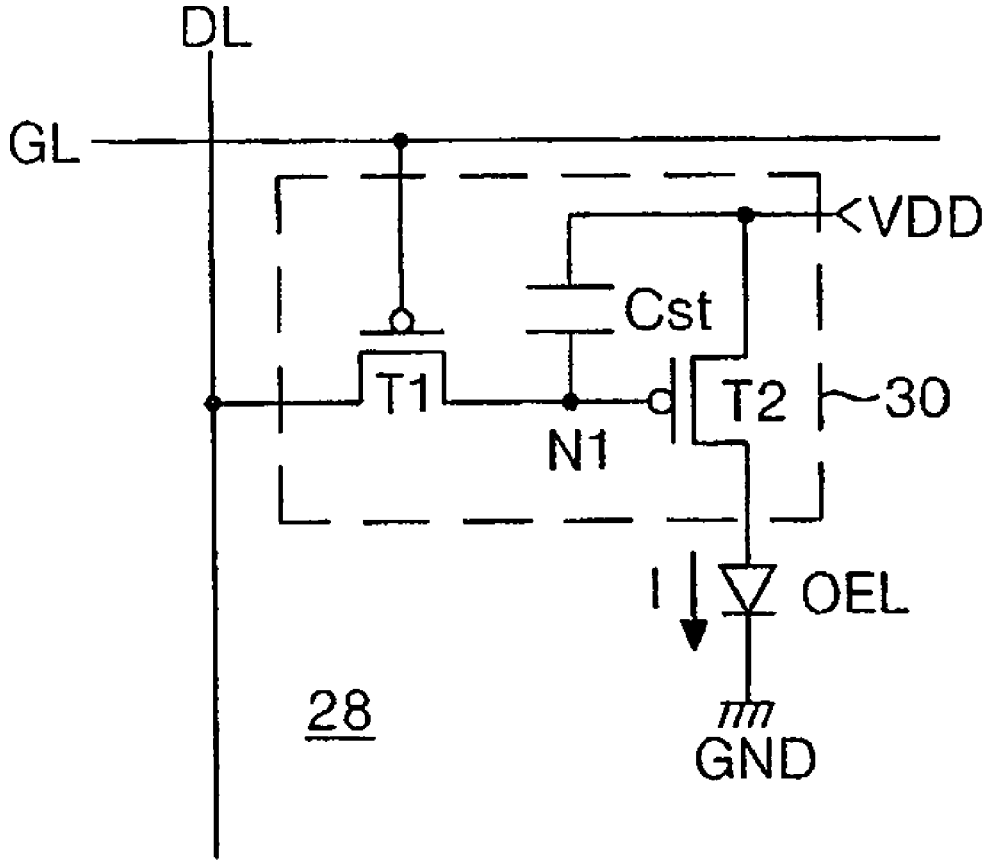
FIG. 3 RELATED ART
FIG. 3 is a circuit diagram of each pixel shown in FIG. 2.
Figure 4:
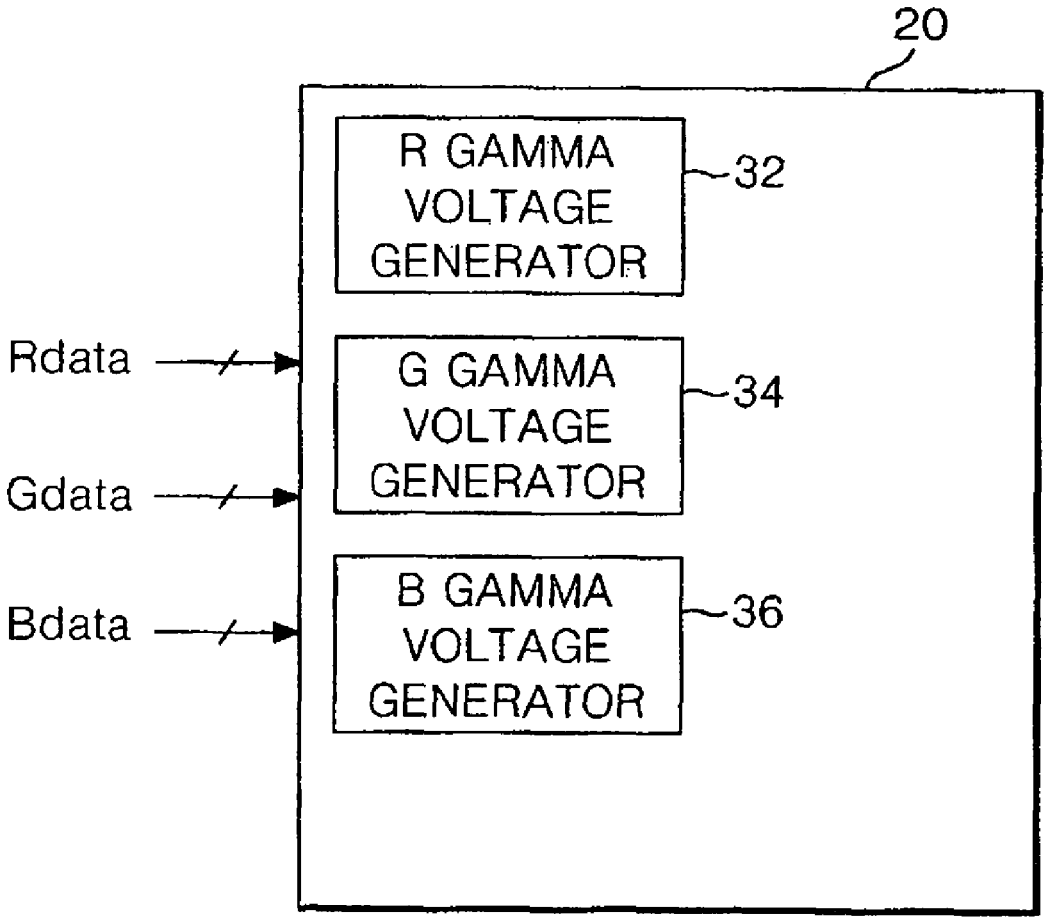
FIG. 4 RELATED ART
FIG. 4 is a block diagram of the data driver shown in FIG. 2.
Figure 5:
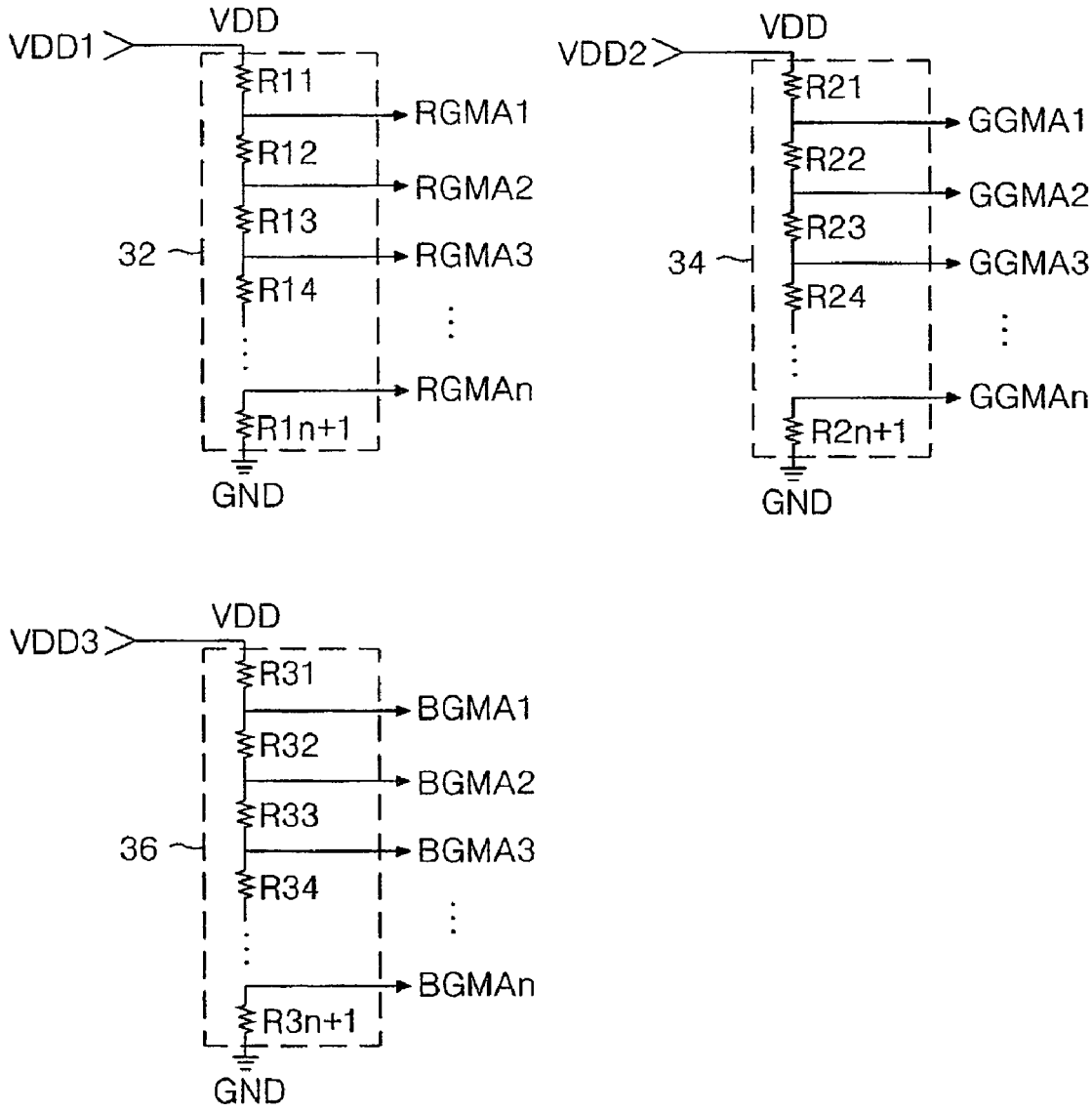
FIG. 5 RELATED ART
FIG. 5 is a circuit diagram of the R, G and B gamma voltage generators shown in FIG. 4.

To this end, as shown in FIG. 3, each pixel 128 includes an EL cell OEL having a cathode connected to a ground voltage source GND, and a cell driver 30 connected to the gate line GL, the data line DL and a supply voltage source VDD and to an anode of the EL cell OEL to thereby drive the EL cell OEL.

The cell driver 30 includes a switching thin film transistor T1 having a gate terminal connected to the gate line GL, a source terminal connected to the data line DL and a drain terminal connected to a first node N1, a driving thin film transistor T2 having a gate terminal connected to the first node N1, a source terminal connected to the supply voltage source VDD and a drain terminal connected to the EL cell OEL, and a capacitor C connected between the supply voltage source VDD and the first node N1.

The switching thin film transistor T1 is turned on when a scanning pulse is applied to the gate line GL, to thereby apply a data signal supplied to the data line DL to the first node N1. The data signal supplied to the first node N1 is charged into the capacitor C and applied to the gate terminal of the driving thin film transistor T2. The driving thin film transistor T2 controls a current amount I fed from the supply voltage source into the EL cell OEL in response to the data signal applied to the gate terminal thereof, to thereby control an amount of light emitted from the EL cell OEL. Furthermore, since the data signal is discharged from the capacitor C even though the switching thin film transistor T1 is turned off, the driving thin film transistor T2 applies a current I from the supply voltage source VDD until a data signal at the next frame is supplied, to thereby maintain the emission of the EL cell OEL.

In operation, the EL display device applies a current signal proportional to an input data to each of the EL cells OEL to radiate the EL cells OEL, thereby displaying a picture. Herein, the EL cells OEL includes a R cell OEL having a red (R) phosphorous material, a G cell OEL having a green (G) phosphorous material, and a B cell OEL having a blue (B) phosphorous material in order to implement color. The three R, G and B cells OEL are combined to implement a color for one pixel. Herein, each of the R, G and B phosphorous materials has different light-emission efficiency. In other words, if data signals having the same level are applied to the R, G and B cells OEL, then brightness levels of the R, G and B cells OEL become different from each other. Thus, gamma voltages for each R, G and B cell are set to be different from each other in order to compensate different brightness of R, G and B cells at a same voltage level for the sake of white balance of the R, G and B cells.

Figure 7:
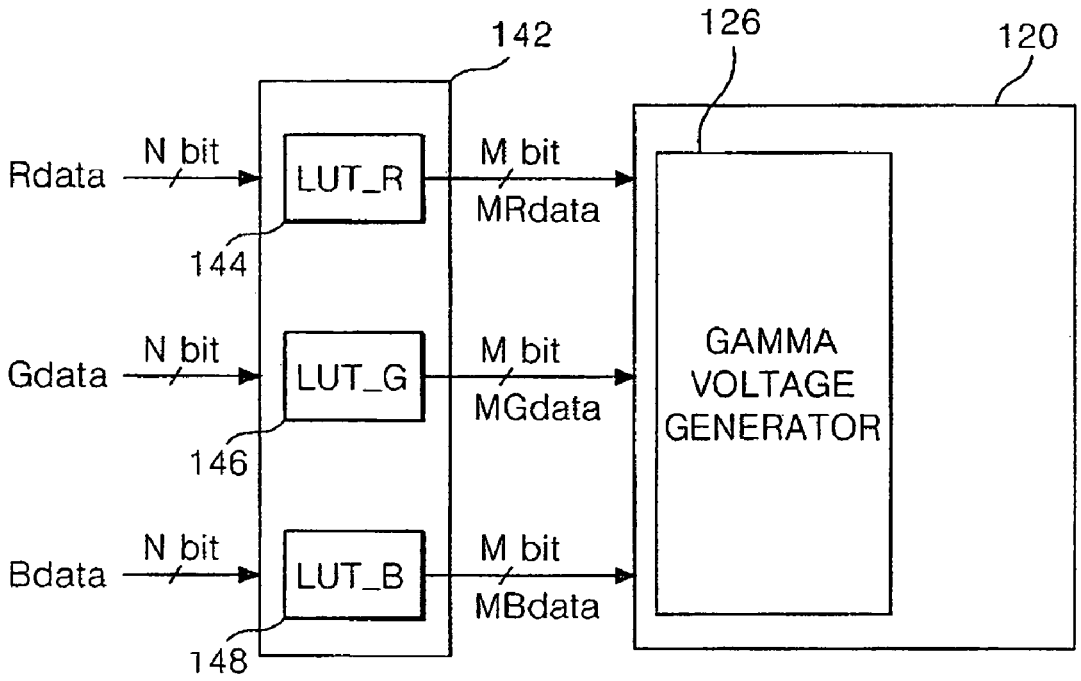
FIG. 7 is a block diagram of the look-up table and the data driver shown in FIG. 6.

The timing controller 140 applies a digital data signal RGB from the exterior (i.e., system) to the data driver 120, and generates a gate control signal GCS, which is required for a driving of the gate driver 118, and a data control signal DCS, which is required for a driving of the data driver 120, using vertical/horizontal synchronizing signals and a main clock from the exterior. In this case, as shown in FIG. 7, the timing controller 140 includes a look-up table 142 for converting an N-bit digital data signal RGB from the exterior into an M-bit digital data signal MRGB.

The look-up table 142 includes a R look-up table 144 for converting an N-bit R digital data signal Rdata into an M-bit digital data signal MRdata, a G look-up table 146 for converting an N-bit G digital data signal Gdata into an M-bit digital data signal MGdata, and a B look-up table 148 for converting an N-bit B digital data signal Bdata into an M-bit digital data signal MBdata. For the sake of explanation, it may be assumed, for example, that the G cell, of the R, G and B cells having different light-emission efficiencies, has about two times higher efficiency than the R cell, while the B cell should have about 2.6 times higher efficiency than the R cell. It may be further assumed, for example, that the look-up table 142 converts 3-bit R, G and B digital data signals Rdata, Gdata and Bdata from the exterior into 5-bit R, G and B digital data signals MRdata, MGdata and MBdata, respectively. To be sure, the actual look-up table should be adjusted, taking into account the relationship among the light emitting efficiencies of the R, G and B cells of an actual device.

Accordingly, as seen from the following Table 1, the look-up table 142 converts 3-bit R, G and B digital data signals Rdata, Gdata and Bdata into 5-bit R, G and B digital data signals MRdata, MGdata and MBdata, respectively. In this case, if each of the 3-bit R, G and B digital data signals Rdata, Gdata and Bdata is '$111_2$' having a maximum brightness, then the R digital data signal Rdata is converted into '$11111_2$'; the G digital data signal Gdata is converted into '$01111_2$'; and the B digital data signal Bdata is converted into '$01100_2$' in consideration of each light-emission efficiency of the R, G and B cells, which are the 5-bit R, G and B digital data signals MRdata, MGdata and MBdata outputted by the look-up table 142. In other words, the look-up table 142 differentiates the gray scale number of each of the 3-bit R, G and B digital data signals Rdata, Gdata and Bdata.

TABLE 1

| RGBdata | MRdata | MGdata | MBdata |
|---|---|---|---|
| 0 | 0 | 0 | 0 |
| 1 | 4 | 2 | 2 |
| 2 | 9 | 4 | 3 |
| 3 | 13 | 7 | 5 |
| 4 | 18 | 9 | 7 |
| 5 | 22 | 11 | 8 |
| 6 | 27 | 13 | 10 |
| 7 | 31 | 15 | 12 |

Accordingly, as can be seen from Table 1, the R look-up table 144 converts a 3-bit R digital data signal Rdata into a 5-bit R digital data signal MRdata having a gray scale number between 0 and 31. The G look-up table 146 converts a 3-bit G digital data signal Gdata into a 5-bit G digital data signal MGdata having a gray scale number between 0 and 15. The B look-up table 148 converts a 3-bit B digital data signal Bdata into a 5-bit B digital data signal MBdata having a gray scale number between 0 and 12.

As descried above, the look-up table 142 differentiates the gray scale number of each of the R, G and B digital data signals MRdata, MGdata and MBdata converted from 2 bits into 5 bits, thereby meeting a white balance of the R, G and B cells having different light-emission efficiencies.

The gate driver 118 sequentially applies a scanning pulse to gate lines GL1 to GLn under control of the timing controller 140.

The data driver 120 converts the R, G and B digital data signals MRdata, MGdata and MBdata converted into 5 bits by the look-up table 142 of the timing controller 140 into analog video signals in response to the data control signal DCS from the timing controller 140. Further, the data driver 120 applies the analog video signals synchronized with the scanning pulse to data lines DL1 to DLm for each one line. To this end, the data driver 120 includes a gamma voltage generator 126.

Figure 8:
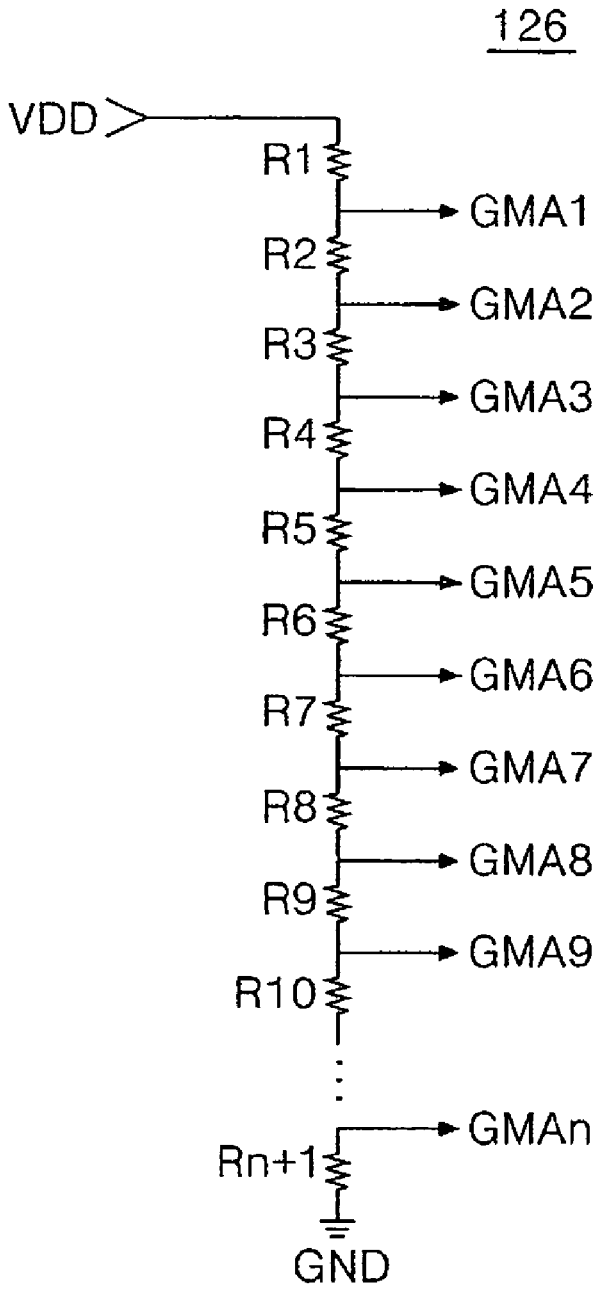
FIG. 8 is a circuit diagram of the gamma voltage generator shown in FIG. 7.

As shown in FIG. 8, the gamma voltage generator 126 includes (n+1) resistors R1, R2, R3, R4, . . . , Rn+1 connected, in series, between the supply voltage source VDD and the ground voltage source GND. Such an gamma voltage generator 126 generates n gamma voltages GMA1 to GMAn corresponding to the 5-bit R, G and B digital data signals MRdata, MGdata and MBdata inputted from the look-up table 142 of the timing controller 140, and transfers the gamma voltages to the data driver 120. In other words, the gamma voltage generator 126 outputs n gamma voltages GMA1 to GMAn having different voltage levels from the nodes between the resistors R1, R2, R3, R4, . . . , Rn+1. Such an gamma voltage generator 126 outputs different 32 gamma voltages GMA, as seen from the following Table 2:

TABLE 2

| RGBdata | GMA |
|---|---|
| 0 | 0.00 |
| 1 | 0.16 |
| 2 | 0.32 |
| 3 | 0.48 |
| 4 | 0.65 |
| 5 | 0.81 |
| 6 | 0.97 |
| 7 | 1.13 |

TABLE 2-continued

| RGBdata | GMA |
|---|---|
| 8 | 1.29 |
| 9 | 1.45 |
| 10 | 1.61 |
| 11 | 1.77 |
| 12 | 1.94 |
| 13 | 2.10 |
| 14 | 2.26 |
| 15 | 2.42 |
| 16 | 2.58 |
| 17 | 0.00 |
| 18 | 0.16 |
| 19 | 0.32 |
| 20 | 0.48 |
| 21 | 0.65 |
| 22 | 0.81 |
| 23 | 0.97 |
| 24 | 1.13 |
| 25 | 1.29 |
| 26 | 1.45 |
| 27 | 1.61 |
| 28 | 1.77 |
| 29 | 1.94 |
| 30 | 2.10 |
| 31 | 2.26 |

Accordingly, the data driver 120 selects n gamma voltages GMA1 to GMAn from the gamma voltage generator 126 corresponding to the respective 5-bit R, G and B digital data signals MRdata, MGdata and MBdata supplied from the look-up table 142 of the timing controller 140 to thereby generate analog video signals.

TABLE 3

| RGBdata | MRdata | MGdata | MBdata |
|---|---|---|---|
| 0 | 0.00 | 0.00 | 0.00 |
| 1 | 0.65 | 0.32 | 0.32 |
| 2 | 1.45 | 0.65 | 0.48 |
| 3 | 2.10 | 1.13 | 0.81 |
| 4 | 2.90 | 1.45 | 1.13 |
| 5 | 3.55 | 1.77 | 1.29 |
| 6 | 4.68 | 2.10 | 1.61 |
| 7 | 5.00 | 2.42 | 1.94 |

More specifically, as can be seen from the above Table 3, the data driver 120 generates R analog video signals with about 0 to about 5V corresponding to 32 gamma voltage GMA1 to GMA32 having different voltage levels from the gamma voltage generator 126 in response to the 5-bit R digital data signal MRdata. The data driver 120 generates G analog video signals with about 0 to about 2.42V corresponding to the 1 st to 16th gamma voltages GMA1 to GMA16 having different voltage levels from the gamma voltage generator 126 in response to the 5-bit G digital data signal MGdata. The data driver 120 generates B analog video signals with about 0 to about 1.94V corresponding to the 1 st to 13th gamma voltages GMA1 to GMA13 having different voltage levels from the gamma voltage generator 126 in response to the 5-bit B digital data signal MBdata.

As mentioned above, the R, G and B analog video signals generated from the data driver 120 is applied to the data lines DL in such a manner to be synchronized with the scanning signal, thereby displaying a desired picture on the EL panel 20.

Meanwhile, the flat panel display device according to the embodiment of the present invention has been described on the basis of the EL display device. However, it should be understood that the principles of the present invention are applicable to other flat panel display devices.

As described above, the flat panel display device according to the present invention includes the look-up table for converting an N-bit digital data from the exterior into an M-bit digital data. The present flat panel display device converts the N-bit digital data into M-bit red, green and blue digital data having different gray scale numbers with the aid of the look-up table, based on different light-emission efficiencies for each red, green and blue light-emitting cell. Thus, the flat panel display device according to the present invention is capable of implementing accurate color using the same gamma voltage generator for each red, green and blue digital data. Accordingly, the flat panel display device according to the present invention uses a single gamma voltage generator for each red, green and blue digital data, so that it can reduce the size of the data driver and the manufacturing cost.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An electro-luminescence display device comprising:

R, G and B cells having different light-emission efficiencies, wherein each of the R, G and B cells has a cathode electrode, an anode electrode and an emitting layer interposed between the cathode electrode and the anode electrode;

a timing controller for generating a gate control signal and a data control signal, wherein the timing controller includes a R look-up table which receives Red N-bit digital data signals and converts the Red N-bit digital data signals into Red M-bit digital data signals, a G look-up table which receives Green N-bit digital data signals and converts the Green N-bit digital data signals into Green M-bit digital data signals, and a B look-up table which receives Blue N-bit digital data signals and converts the Blue N-bit digital data signals into Blue M-bit digital data signals, wherein each of N and M is an integer, M is greater than N, and numbers of the gray scale values of the Red, Green, and Blue N-bit digital data signals are same each other, and wherein a number of gray scale values of the Red M-bit digital data signals is larger than that of the Green M-bit digital data signals, and a number of gray scale values of the Green M-bit digital data signals is larger than that of the Blue M-bit digital data signals;

a gamma voltage generator having a single resistor string in which a plurality of resistors are serially connected, which receives all of the Red, Green and Blue M-bit digital data signals and generates a plurality of gamma voltages corresponding to the Red, Green and Blue M-bit digital data signals; and a data driving circuit which generates Red, Green and Blue analog data signals corresponding to the plurality of gamma voltages responding to the data control signal, and supplies the Red, Green and Blue analog data signals to respective Red, Green and Blue pixels, wherein the Red analog data signal applied to the respective pixel has a voltage level of 0V to 5V, wherein the Green analog data signal applied to the respective pixel has a voltage level of only 0V to 2.5V, and wherein the Blue analog data signal applied to the respective pixel has a voltage level of only 0V to 1.9V.

2. The electro-luminescence display device according to claim 1, wherein each of the pixels is an electro-luminescence cell.

3. A method of driving an electro-luminescence display device including R, G and B and cells having different light-emission efficiencies, the method comprising:

receiving Red, Green and Blue N-bit digital data signals;

converting the Red, Green and Blue N-bit digital data signal into Red, Green and Blue M-bit digital data signals, respectively, wherein each of N and M is an integer, M is greater than N;

generating a plurality of gamma voltages corresponding to the Red, Green and Blue M-bit digital data signals by a gamma voltage generator having a single resistor string in which a plurality of resistors are serially connected, which receives all of the Red, Green and Blue M-bit digital data signals;

generating Red, Green and Blue analog data signals corresponding to the plurality of gamma voltages; and applying the Red, Green and Blue analog data signals to respective Red, Green and Blue pixels, wherein each of Red, Green and Blue pixels includes a cell which has a cathode electrode, an anode electrode and an emitting layer disposed between the cathode electrode and the anode electrode, wherein numbers of the gray scale values of the Red, Green, and Blue N-bit digital data signals are same each other, a number of gray scale values of the Red M-bit digital data signals is larger than that of the Green M-bit digital data signals, and a number of gray scale values of the Green M-bit digital data signals is larger than that of the Blue M-bit digital data signals, wherein the Red analog data signal applied to the respective pixel has a voltage level of 0V to 5V, wherein the Green analog data signal applied to the respective pixel has a voltage level of only 0V to 2.5V, and wherein the Blue analog data signal applied to the respective pixel has a voltage level of only 0V to 1.9V.

4. The method according to claim 3, wherein each of the pixels is an electro-luminescence cell.

* * * * *